US006793609B1

(12) United States Patent
Fan

(10) Patent No.: US 6,793,609 B1
(45) Date of Patent: Sep. 21, 2004

(54) STATIONARY EXERCISE CYCLE

(76) Inventor: Jeeng-Neng Fan, No. 34, Alley 10, Lane 54, Sec. 2, Yangsin Rd., Yang mei, Taoyuan (TW)

( * ) Notice: Subject to any disclaimer, the term of this patent is extended or adjusted under 35 U.S.C. 154(b) by 0 days.

(21) Appl. No.: 10/377,879

(22) Filed: Mar. 4, 2003

(51) Int. Cl.[7] ..... A63B 69/16
(52) U.S. Cl. ..... 482/57; 482/62
(58) Field of Search ..... 482/57–65, 95, 482/96, 51

(56) References Cited

U.S. PATENT DOCUMENTS 3,024,023 A * 3/1962 Steller ..... 482/62
3,762,703 A * 10/1973 Gibbs ..... 482/62
4,479,646 A * 10/1984 Beistegui Chirapozu ..... 482/62
4,548,406 A * 10/1985 Beistegui Chirapozu ..... 482/62
5,145,477 A * 9/1992 Han ..... 482/57
5,643,145 A * 7/1997 Lo et al. ..... 482/57
5,931,765 A * 8/1999 Huang ..... 482/57
6,419,613 B2 * 7/2002 Stearns et al. ..... 482/57

* cited by examiner

*Primary Examiner*—S. R. Crow
(74) *Attorney, Agent, or Firm*—Rosenberg, Klein & Lee

(57) ABSTRACT

An improved stationary exercise cycle comprised of a handlebar and a saddle respectively installed at two extremities of a swing rod, a base support rod to which the anterior extremity of the swing rod is hinged, a push arm extending downward from the posterior extremity of the swing rod, and a guide wheel disposed at the lower end of the push arm that contacts a polygonal drive wheel over the axle of the bottom bracket shell on the base. When a person treadles the pedals and thereby rotates the polygonal drive wheel, the guide wheel contacts the polygonal drive wheel and the support rod on the base serves as a fulcrum on which the swing rod pivots upward and downward in a seesaw fashion, with the handlebar and the saddle at the two extremities of the swing rod alternately rising and falling such that the user not only strengthens both legs, but also invigorates the arms and entire body, thereby providing for a massage-like yet effective and comprehensive physical exercise routine.

4 Claims, 8 Drawing Sheets

STATIONARY EXERCISE CYCLE

BACKGROUND OF THE INVENTION

1) Field of the Invention

The invention herein relates to physical fitness apparatus, specifically an improved stationary exercise cycle.

2) Description of the Prior Art

The structure and operation of conventional indoor stationary exercise cycles typically provides for the treadling of pedals with two feet to thereby strengthen and exercise both legs in a manner similar to that of riding a bicycle. Since the said stationary exercise cycles are normally equipped with a friction-based, resistance adjustment device, the user can adjust pedaling drag to the most appropriate setting needed for a challenging leg workout. While it cannot be denied that the operation of such stationary exercise cycles achieves the objective of adaptive utilization, since their conventional structure is unsophisticated and only provides for a single regime of leg pedaling exercise, they are monotonous, uninteresting, and even of decreased exercise effectiveness.

As a result, manufacturers have attempted to further enhance stationary exercise cycles by disposing the handlebar as separate left and right elements with a matching left and right connecting rod then coupling the left and the right handlebar elements to the bottom bracket shell such that when the exerciser treadles the pedals, the said left and right handle bar elements rock forward and backward in a cadence with them to thereby achieve the flexioning of both legs as well as the forward extension and rearward retraction of both arms to effectively exercise and build up the limbs. Since the structure of such improved stationary exercise cycles conditions both the hands and feet at the same time, they are superior to the conventional counterparts in achieving the expected exercise results. However, besides extending and retracting the arms and legs, such structures have shortcomings in that they are incapable of exercising other parts of the human body.

SUMMARY OF THE INVENTION

The primary objective of the invention herein is to provide an improved stationary exercise cycle in which a swing rod having a handlebar and saddle respective installed at its anterior and posterior extremities is capable of pivoting upward and downward on a support rod of a base that serves as a fulcrum and, furthermore, a polygonal drive wheel installed at the bottom bracket shell of the base which impels a push rod at the posterior extremity of the swing rod during rotation such that when the exerciser treadles the pedals, the said saddle and handlebar are reciprocally drawn higher and lower which not only achieves the expected objective of strengthening the two legs of the exerciser, but at the same time also invigorates the arms and entire body, thereby providing for a massage-like yet effective, comprehensive physical exercise routine.

Another objective of the invention herein is to provide an improved stationary exercise cycle, wherein a height adjuster is disposed between the said swing rod and base such that the amplitude of the said swing rod relative to the body of the exerciser can be varied and at the same time the intensity and mode of vibration to the exerciser dampened to afford the exerciser a more comfortable workout.

Yet another objective of the invention herein is to provide an improved stationary exercise cycle, wherein the said height adjuster is equipped with a drag device that, as per actual utilization requirements, allows a user-selectable leg strengthening or total body exercise routine to thereby enable multi-purpose application.

DETAILED DESCRIPTION OF THE INVENTION

Figure 1:
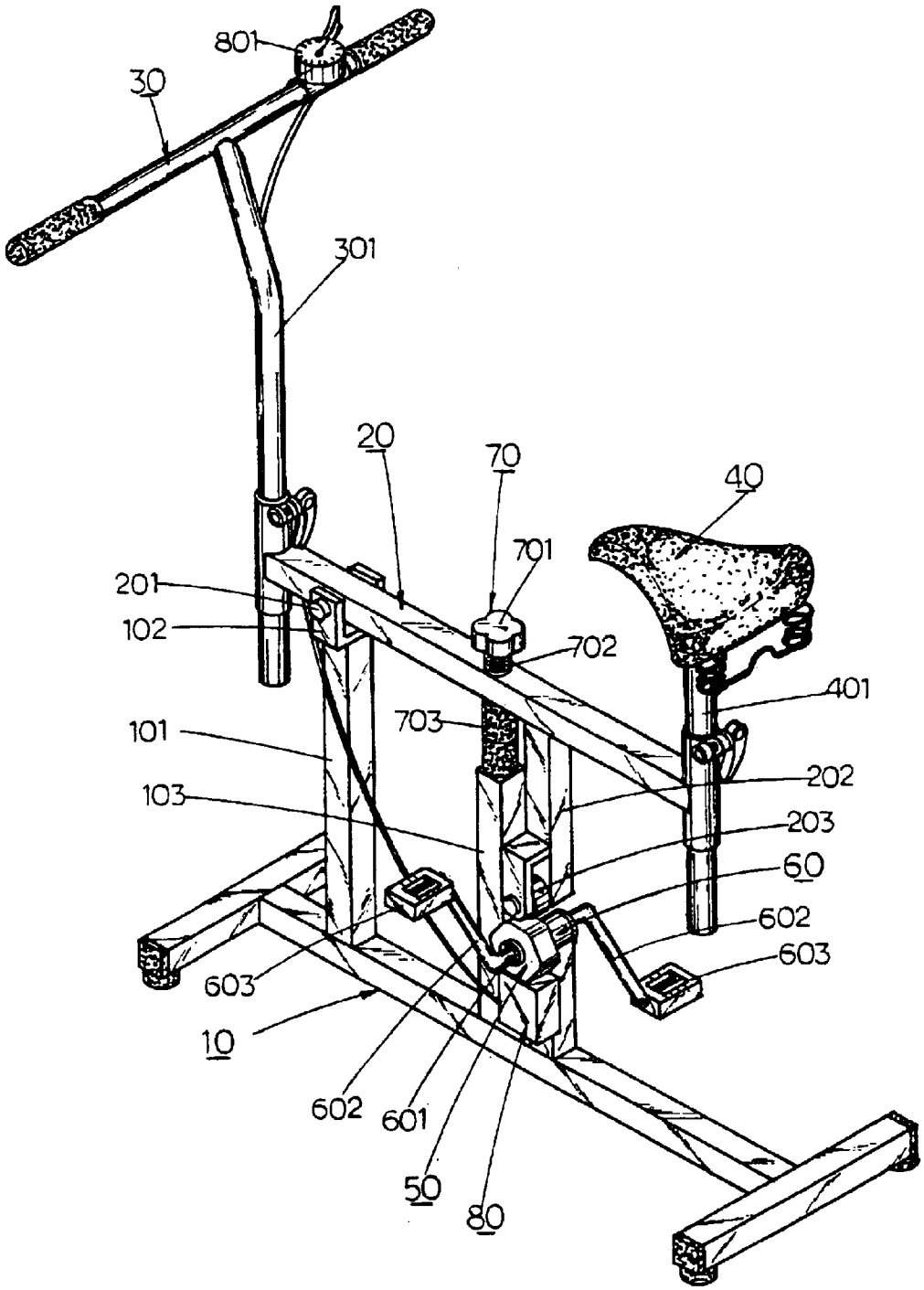
FIG. 1 is an isometric drawing of an embodiment of the invention herein.
Figure 2:
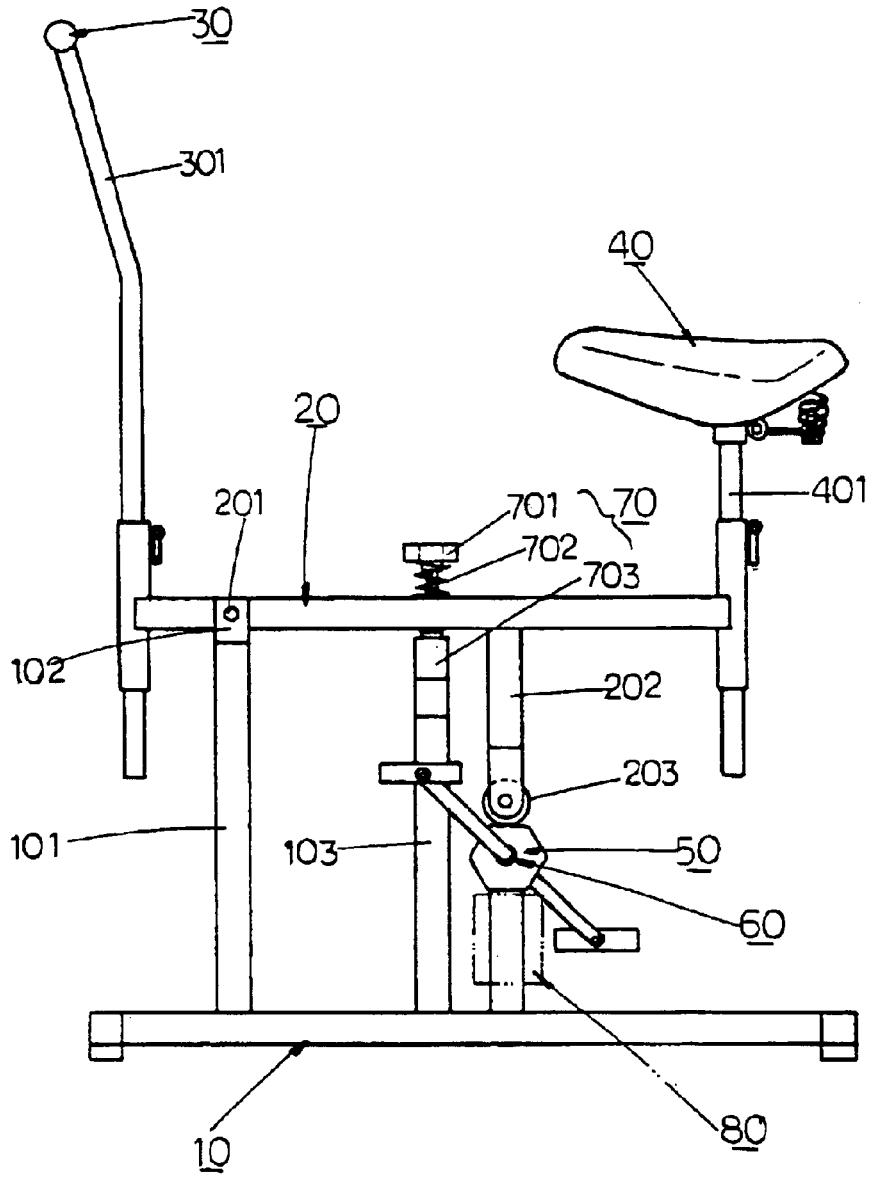
FIG. 2 is an orthographic drawing of FIG. 1.
Figure 3:
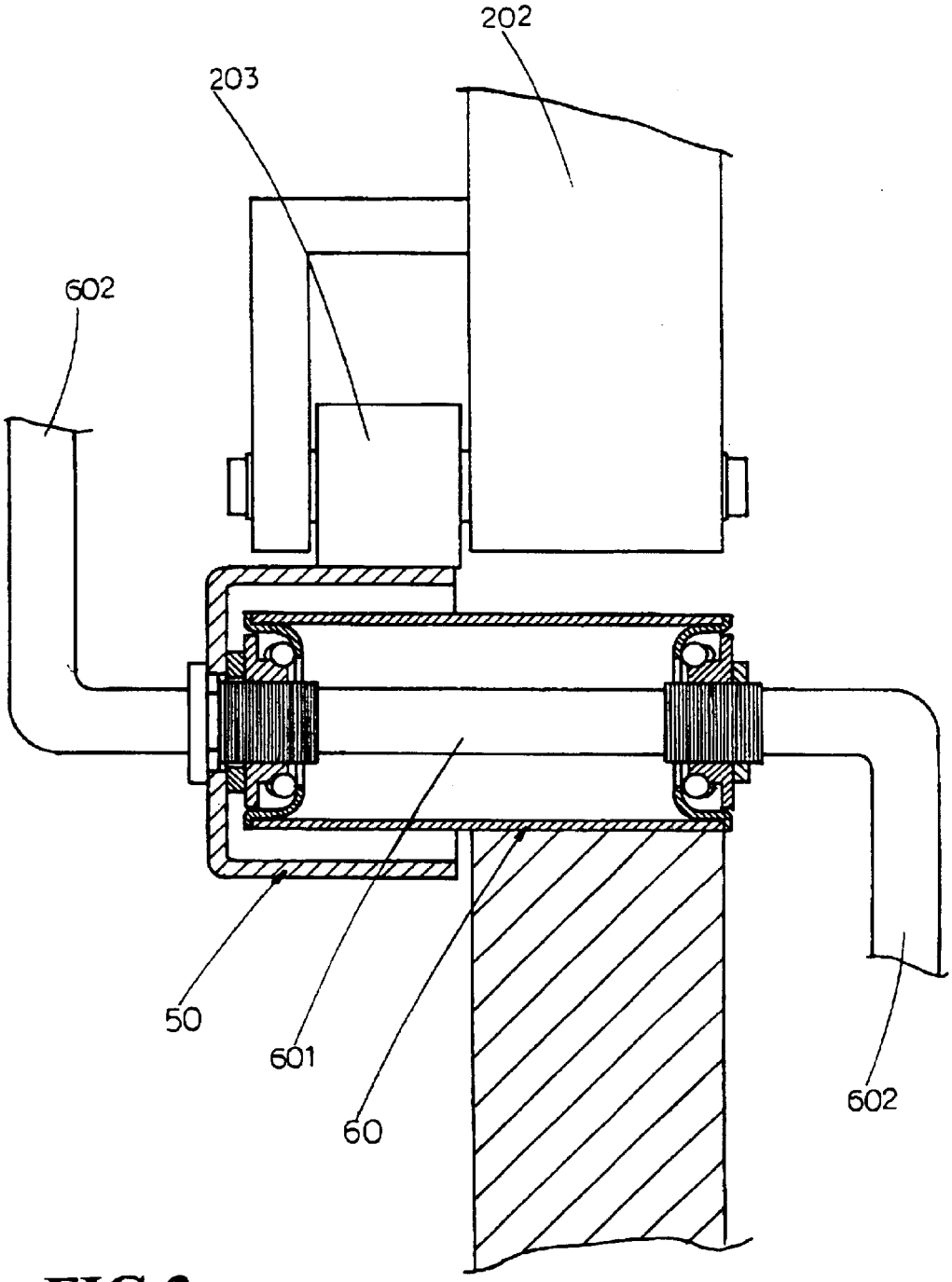
FIG. 3 is a cross-sectional drawing of the drive wheel of the invention herein installed on the axle in the bottom bracket shell.
Figure 4:
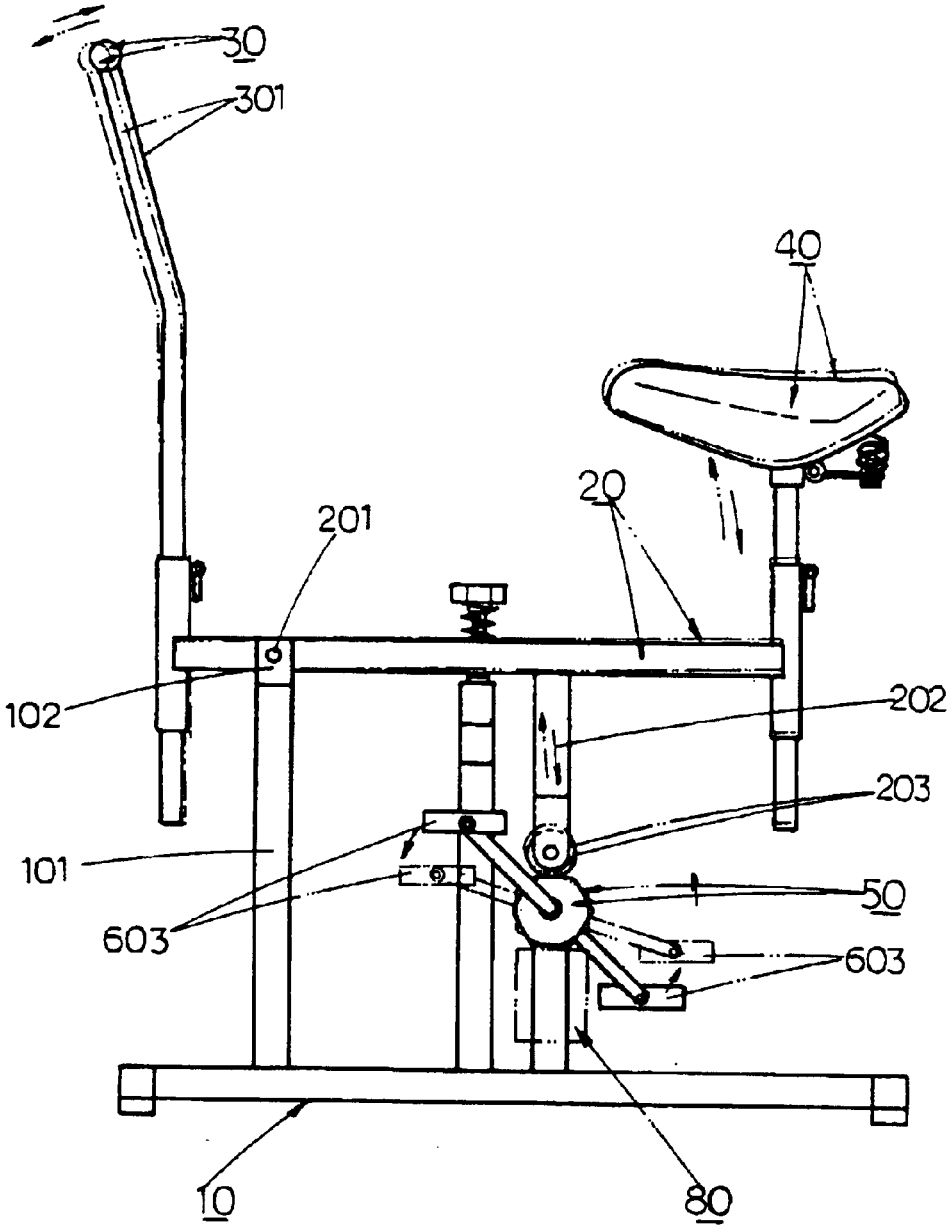
FIG. 4 is an orthographic drawing that illustrates the movement of the pedals shown in FIG. 2.

Referring to FIG. 1, FIG. 2, and FIG. 3, the improved stationary exercise cycle of the invention herein is comprised of a base 10 having near the forward aspect an upwardly projecting support rod 101 with a clevis 102 disposed on its top end; a swing rod 20 that in addition to providing for the respective installation of a handlebar 30 stem 301 and a saddle 40 seat post 401 at its anterior and posterior extremities also has a lynch pin 201 inserted proximal to the anterior extremity hinging it to the clevis 102 of the base 10 support rod 101, thereby enabling lever-type ascension and descension, as well as a downwardly extending push arm 202 situated proximal to the posterior extremity with a guide wheel 203 disposed on its lower end; a drive wheel 50 that is polygonal in design, positioned at one end of a bottom bracket shell 60 on an axle 601, and contacts the guide wheel 203 at the lower end of the swing rod 20 push arm 202, wherein the said bottom bracket shell 60 is situated on the base 10—since the structure of the said shell 60 is similar to that utilized on conventional bicycles, it shall not be further elaborated—and the axle 601 is a section of a one-piece crank 602 and can be a component of a multiple-piece crank set; a height adjuster 70 installed in the swing rod 20 adjacent to the push arm 202 that has an adjustment knob 701, a spring 702, and a cushion block 703, wherein after the adjustment knob 701 is rotated downward in the swing rod 20, the tension of the spring 702 is vectored upward such that the said cushion block 703 at the lower end of the adjustment knob 701 remains fixed against the top end of a stop rod 103 disposed in the base 10; and a drag device 80 disposed on the base 10 that generates friction along the drive wheel 50, the structure of which is similar to that of conventional dampers, magnetic controls, brake belts, and other similar means, with the friction produced at the drive wheel 701 varied via a controlling resistance adjuster 801.

Figure 6:
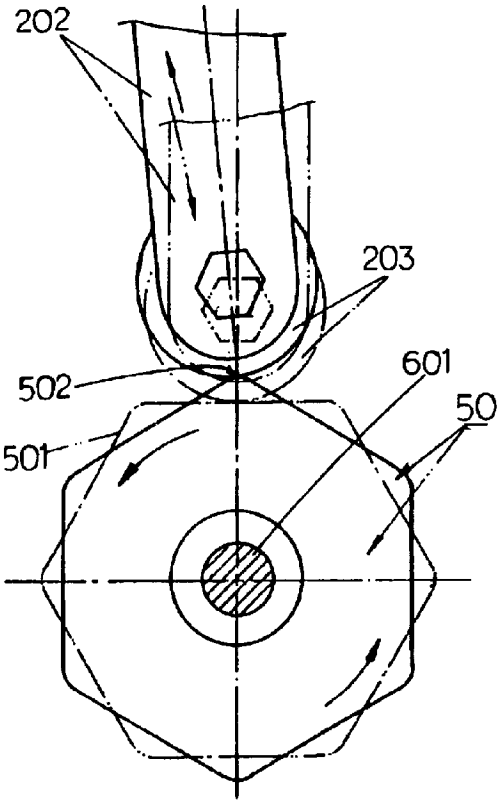
FIG. 6 is an orthographic drawing of the drive wheel of the invention herein with one of its angular points contacting the guide wheel of the push arm.
Figure 5:
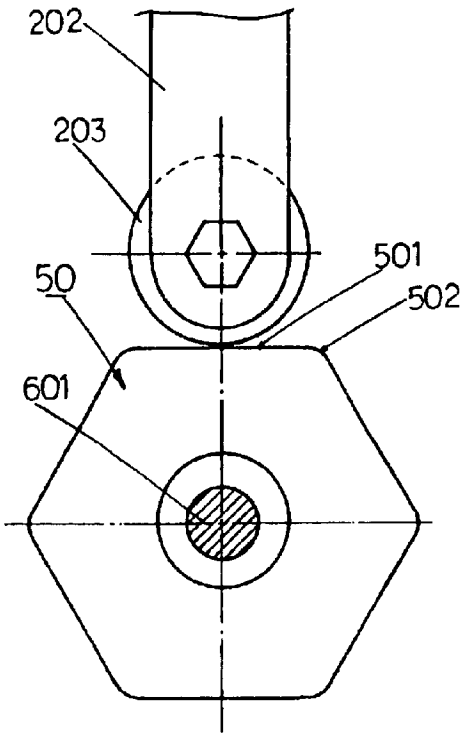
FIG. 5 is an orthographic drawing of the drive wheel of the invention herein with one of its contiguous sides contacting the guide wheel of the push arm.

Utilizing the said structure of the invention herein, referring to FIG. 4, FIG. 5, FIG. 6, and FIG. 7, since the anterior extremity of the said swing rod 20 is hinged to the clevis 102 of the base 10 support rod 101, the said base support rod 101 serves as a fulcrum of leveraged pivotal sway; the said handlebar 30 and saddle 40 are respectively installed at the anterior and posterior extremities of the swing rod 20 and as the said guide wheel 203 disposed at the lower end of the swing rod 20 push arm 202 constantly contacts the polygonal drive wheel 50, when the exerciser sits on the saddle 40 to treadle the pedals 603 and thereby rotate the drive wheel 50, the contiguous sides 501 and angular points 502 profiled at differing height along the drive wheel 50 impinge the guide wheel 203 during the said rotation (as shown in FIG. 5 and FIG. 6), causing the said swing rod 20 to move continuously in a seesaw manner and vibrate parasitically, with the said exerciser seated on the saddle 40 subjected to the resultant pulsations which allows the said exerciser to not only strengthen both legs by treadling the pedals, but at the same time soothingly yet effectively exercise the arms during the vibration process.

Figure 7:
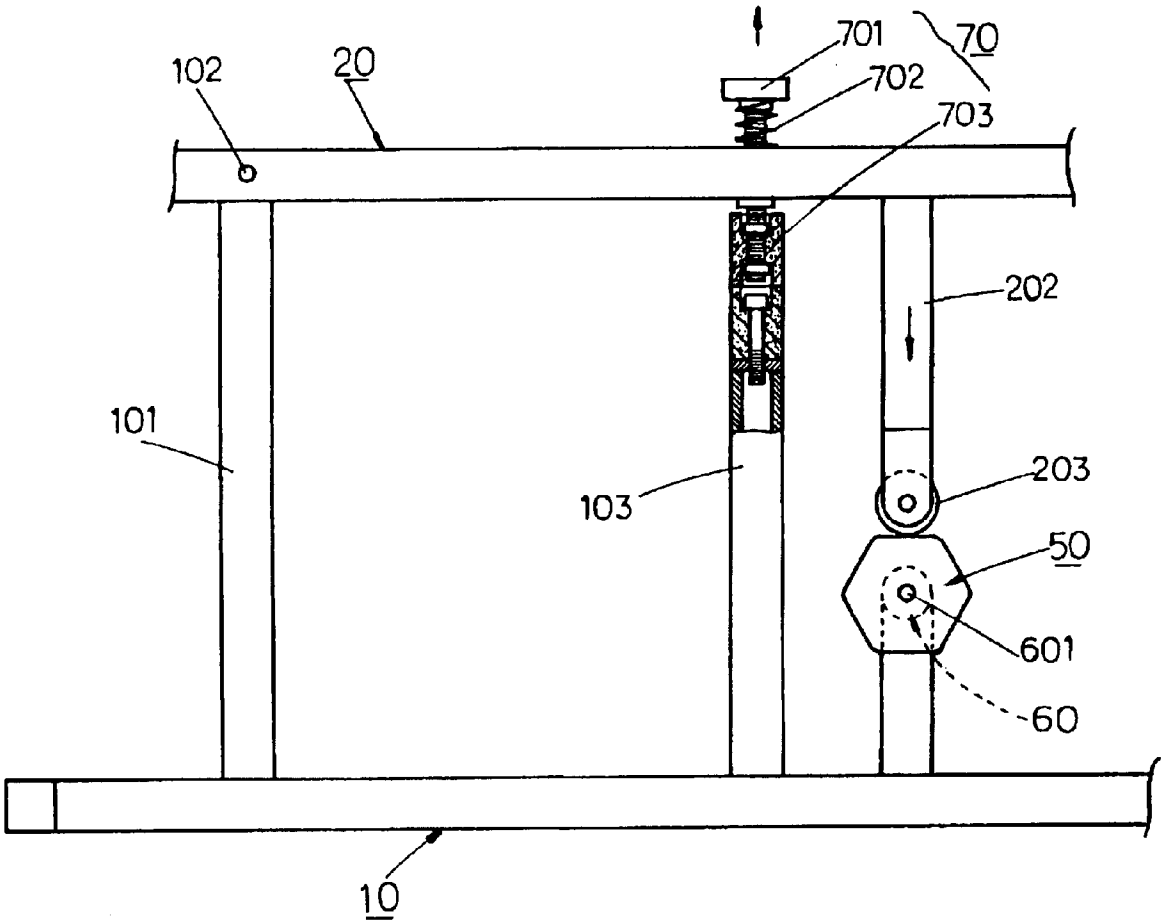
FIG. 7 is a cross-sectional drawing of the height adjuster of the invention herein set such that the guide wheel of the push arm contacts the drive wheel.
Figure 8:
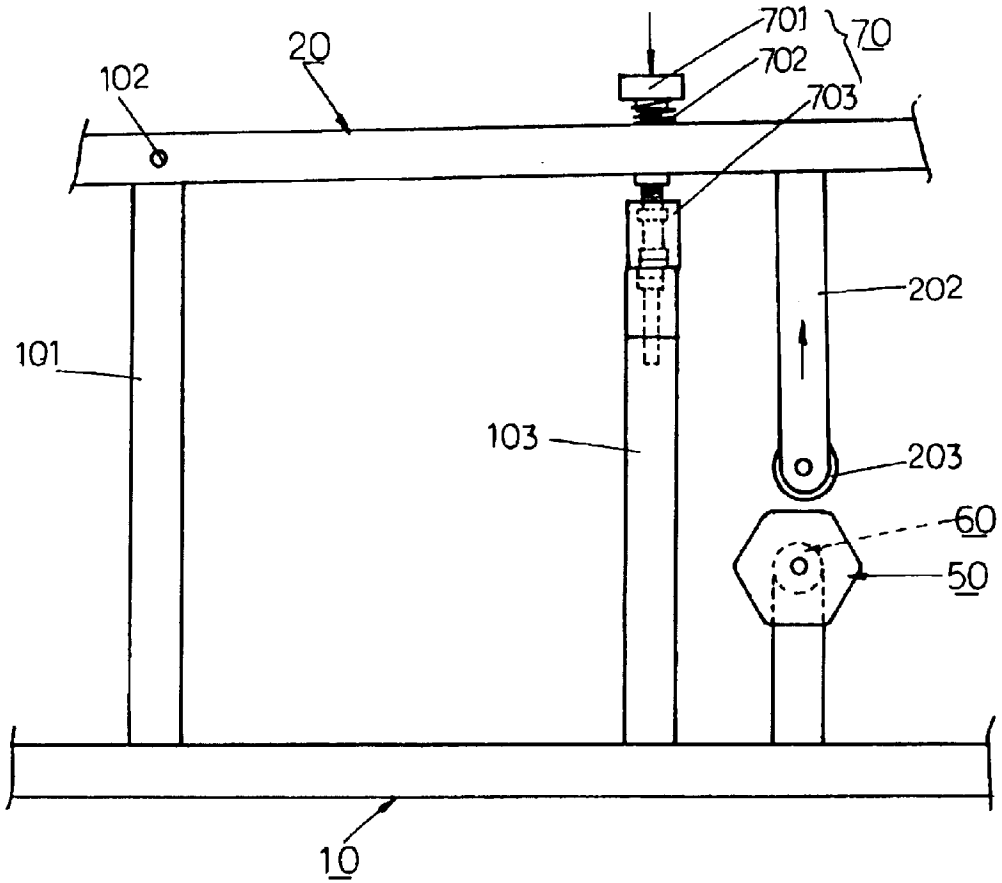
FIG. 8 is a cross-sectional drawing of the height adjuster of the invention herein set such that the guide wheel of the push arm does not contact the drive wheel.

Referring to FIG. 7 and FIG. 8, since the height adjuster 70 is installed adjacent to the swing rod 20 push arm 202, a person can not only turn the adjustment knob 701 upward to bring the guide wheel 203 disposed at the lower end of the swing rod 20 push arm 202 into the said constant contact with the drive wheel 50 (see FIG. 4, FIG. 5, FIG. 6, and FIG. 7) and thereby enable the exerciser to simultaneously pedal with both legs and exercise the entire body, but can also turn the adjustment knob 701 downward to bring the cushion block 703 against the stop rod 103 of the base 10 and thus lift the swing rod 20 (see FIG. 8) such that the guide wheel 203 no longer contacts the drive wheel 50, enabling the exerciser to treadle vigorously but only exercise the legs. Since the height adjuster 70 is then capable of incrementally raising and lowering the swing rod 20 as well as altering the scope of contact during rotation between the drive wheel 50 and the guide wheel 203 (i.e., the farther down the swing rod 20 push arm 202, the greater the scope of contact in terms of area and degree between the said polygonal drive wheel 50 and the guide wheel 203; in contrast, the higher up the swing rod 20 push arm 202, the smaller the scope of contact in terms of area and degree between the said polygonal drive wheel 50 and the guide wheel 203), it directly changes the amplitude of the swing rod 20 and thus that of the handlebar 30 and the saddle 40, thereby enabling the exerciser to alter the intensity and mode of vibration delivered to the body and the arms. In other words, the height adjuster 70 allows exercisers a functional means of variable control over the amplitude of the swing rod 20 to accommodate all levels of physical condition and actual application requirements, thereby enabling maximum effectiveness by providing for the most suitable form of exercise.

As described above, since the said drag device 80 can be set by the resistance adjuster 801 to differing magnitudes of friction against the drive wheel 50, the exerciser can partake of a total-body vibratory massage workout or just pedal exclusively to strengthen the legs, during which time the resistance adjuster 801 can be varied to meet actual utilization requirements to produce both optimal and comfortable pedaling rates, thereby providing for most effective exercise results.

Figure 10:
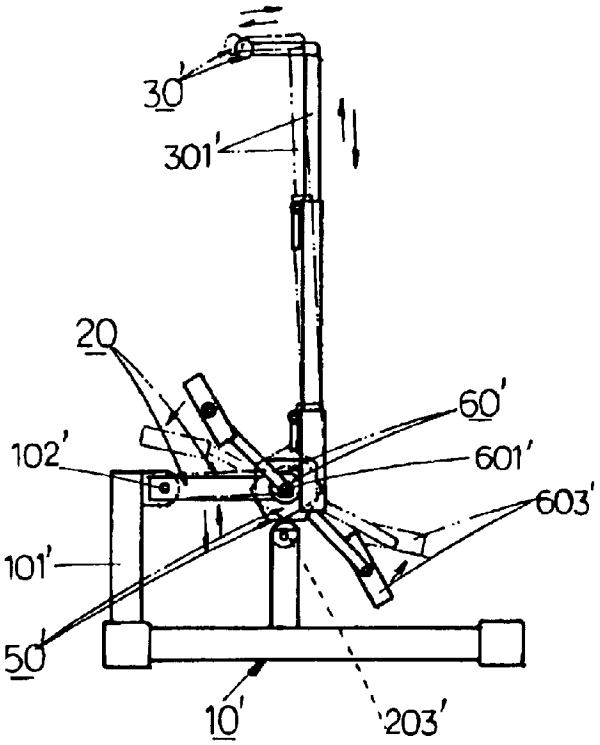
FIG. 10 is an orthographic drawing that illustrates the movement of the pedals shown in FIG. 9.
Figure 9:
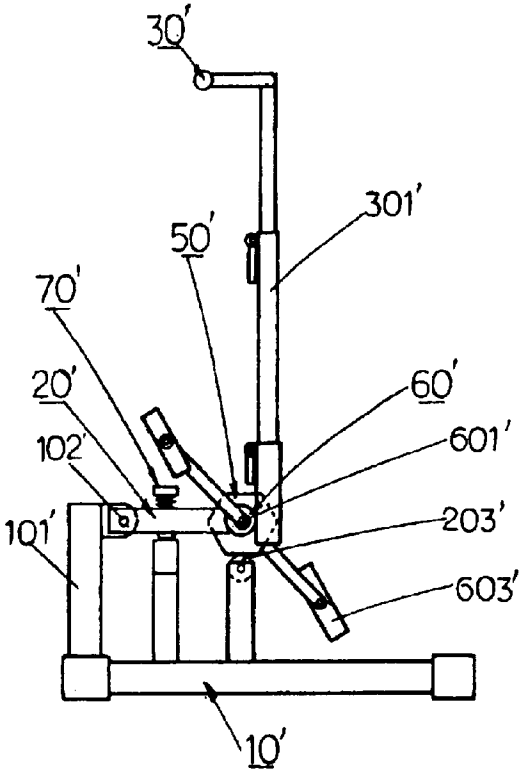
FIG. 9 is an orthographic drawing of another embodiment of the invention herein.

Referring to FIG. 9 and FIG. 10, the drawings of another embodiment of the invention herein; as indicated in the drawings, one extremity of the said swing rod 20' is hinged by a lynch pin 102' to the upper end of the base 10' support rod 101' such that it is capable of pivoting upward and downward, the bottom bracket shell 60' and the handlebar 30' stem 301' are disposed at the other extremity of the swing rod 20', the polygonal drive wheel 50' is as previously described positioned at one end of the bottom bracket shell 60' axle 601', and the said drive wheel 50' contacts the guide wheel 203' which is disposed on the base 10'; in this embodiment, the person operates from a separate chair which facilitates usage of the present invention in a smaller space, but similarly is convenient to utilize. For example, when utilized in a living room, a seated person can watch television and treadle the pedals 603' with both hands placed on the handlebar 30' such that as the polygonal drive wheel 50' rotates along with the axle 601', the lynch pin 201' serves as a fulcrum on which the swing rod 20' and the handlebar 30' seesaw and vibrate simultaneously to facilitate an invigorating massage and brisk workout to the legs, hands, and upper body of the exerciser. To further meet utilization requirements, the height adjustor 70' previously described (as shown in FIG. 1 and FIG. 9) is similarly installed to vary the amplitude of the swing rod 20', the handlebar 30', and the drive wheel 50'.

In the said embodiment, the said bottom bracket shell 60' and the drive wheel 50' can also be disposed on the base 10' as shown in FIG. 1, with the swing rod 20' guide wheel 203' then positioned coincident to the guide wheel 50' such that when a person treadles the pedals 603', the vibrations generated reach the handlebar 30'.

What is claimed is:

1. An improved stationary exercise cycle comprising a base, a support rod extending from said base, a swing rod pivotally coupled to a top end of said support rod, a handlebar and a saddle respectively installed at anterior and posterior extremities of the said swing rod; said swing rod having a downwardly extending push arm spaced from said pivotal coupling with said support rod, said push arm having a guide wheel disposed on a lower end thereof; said base having a drive wheel rotatable mounted thereto, said drive wheel having a polygonal perimeter contour aligned with said guide wheel and having a crank coupled thereto for rotatably driving said drive wheel, said crank having a pair of pedals respectively coupled to opposing ends thereof; said base having a height adjuster extending therefrom and coupled to said swing rod proximal to the posterior extremity thereof and capable of being raised and lowered to control whether said guide wheel on said push arm of said swing rod is suspended or rolls in contact with the said drive wheel; said base having a drag device mounted thereto for directly providing frictional contact with said drive wheel.

2. The improved stationary exercise cycle of as recited in claim 1, wherein said height adjuster consists of a cushion block coupled to said swing rod by a spring biased adjustment knob; said cushion block being shifted against a stop rod in said base during up and down movement to vary an extent of displacement said push arm and said guide wheel therewith.

3. An improved stationary exercise cycle comprising a base, a support rod extending from said base, a swing rod having one end pivotally coupled to said support rod, and a handlebar coupled to an opposing end of said swing rod; said base having a guide wheel extending therefrom in spaced relationship from said support rod; said swing rod having a drive wheel rotatable mounted thereto, said drive wheel having a polygonal perimeter contour aligned with said guide wheel and having a crank coupled thereto for rotatably driving said drive wheel, said crank having a pair of pedals respectively coupled to opposing ends thereof; said swing rod thereby being pivoted up and down along with said handlebar, responsive to rotation of said polygonal drive wheel in contact with said guide wheel.

4. The improved stationary exercise cycle as recited in claim 3, wherein said base includes a height adjuster extending therefrom and coupled to said swing rod, said height adjustor varying an extent of upward and downward movement of said swing rod.

* * * * *